US011576460B2

(12) United States Patent
Botta Aleman

(10) Patent No.: US 11,576,460 B2
(45) Date of Patent: Feb. 14, 2023

(54) SHOE SOLE

(71) Applicant: Jose Botta Aleman, Miami, FL (US)

(72) Inventor: Jose Botta Aleman, Miami, FL (US)

( * ) Notice: Subject to any disclaimer, the term of this patent is extended or adjusted under 35 U.S.C. 154(b) by 0 days.

(21) Appl. No.: 15/942,827

(22) Filed: Apr. 2, 2018

(65) Prior Publication Data

US 2019/0297994 A1 Oct. 3, 2019

(51) Int. Cl.
*A43B 13/02* (2022.01)
*A43B 5/12* (2006.01)
*A43B 13/37* (2006.01)

(52) U.S. Cl.
CPC ..... *A43B 13/023* (2013.01); *A43B 5/12* (2013.01); *A43B 13/37* (2013.01)

(58) Field of Classification Search
CPC ..... A43B 13/37; A43B 13/23; A43B 13/122; A43B 13/148; A43B 13/226; A43B 13/141; A43B 13/16; A43B 13/087; A43B 5/12; A43B 5/001; A43B 5/18; A43B 7/22; A43B 7/142; A43B 7/1495; A43B 7/14; A43B 23/087; A43B 23/227; A43B 2/0042; A43B 13/00; A43B 13/023; A43B 13/02; A43B 13/14; A43B 13/143; A43B 13/146; A43B 13/145; A43B 13/184; A43B 13/188; A43B 13/28
USPC ..... 36/25, 25 R, 8.3, 59 C, 114–116
See application file for complete search history.

(56) References Cited

U.S. PATENT DOCUMENTS 2,162,912 A * 6/1939 Craver ..... A43B 13/223 D2/960
2,168,303 A * 8/1939 Sothen ..... A43B 5/12 116/148
D325,806 S * 5/1992 Austin ..... D2/955
5,682,685 A * 11/1997 Terlizzi ..... A43B 5/12 36/31
6,233,846 B1 * 5/2001 Sordi ..... A43B 5/12 36/105
6,836,978 B1 * 1/2005 Lauer ..... A43B 13/14 36/102
D594,196 S * 6/2009 Recchi ..... D2/951
7,571,556 B2 * 8/2009 Hardy ..... A43B 13/188 36/28
D698,537 S * 2/2014 McClaskie ..... D2/951
2001/0005947 A1 * 7/2001 Sordi ..... A43B 13/141 36/31
2007/0107264 A1 * 5/2007 Meschter ..... A43B 23/227 36/76 R
2007/0227045 A1 * 10/2007 Aveni ..... A43B 3/24 36/8.3
2010/0251567 A1 * 10/2010 McInnis ..... A43B 7/24 36/35 B
2010/0293815 A1 * 11/2010 Ferrigan ..... A43B 7/142 36/25 R (Continued)

FOREIGN PATENT DOCUMENTS

WO WO-2007069069 A2 * 6/2007 ..... A43B 3/0063

*Primary Examiner* — Khoa D Huynh
*Assistant Examiner* — Uyen T Nguyen
(74) *Attorney, Agent, or Firm* — DP IP Group; Franco S. De Liguori

(57) ABSTRACT

The present invention includes a sole that can be used as a dance or a general shoe. The protruding platforms of the sole are arranged, oriented, and dimensioned to permit ruggedness, dancing, and substantial grippiness for both dance moves as well as general wear.

20 Claims, 5 Drawing Sheets

(56) References Cited

U.S. PATENT DOCUMENTS

| | | | | |
|---|---|---|---|---|
| 2011/0030240 | A1* | 2/2011 | Schmidt | A43B 5/10 36/35 R |
| 2012/0137544 | A1* | 6/2012 | Rosa | A43B 7/144 36/105 |
| 2014/0290098 | A1* | 10/2014 | Loverin | A43B 13/37 36/27 |
| 2016/0302522 | A1* | 10/2016 | Meschter | A43B 13/122 |
| 2018/0271211 | A1* | 9/2018 | Perrault | A43D 1/02 |

* cited by examiner

SHOE SOLE

FIELD OF THE INVENTION

The present invention relates to the field of apparel and more specifically to the field of footwear.

BACKGROUND

Dancing shoes have generally been considered to be a separate, specialized category of footwear. One does not dance in general shoes, and one does not wear dancing shoes except when dancing. The moves required for dancing necessitate that a dance shoe has specific characteristics. Many of these characteristics are undesirable for general footwear, such as smooth surfaces for sliding. Furthermore, dance shoes worn on non-dance occasions have a tendency to ruin the characteristics of the dance shoes that make them effective at dancing. There has not been an acceptable attempt to merge dance shoes and general shoes.

Therefore, there is a need for a shoe that can be worn while dancing and generally, while achieving the goals of both footwear.

SUMMARY

The present invention is directed to a shoe sole able to be worn as an everyday article of footwear and as an improved dance shoe. The sole includes a foot pad portion, an interstitial portion, and a heel portion. The distal sole base pad portion has several elements, including a major contact platform for controlled stops, a circular spinner platform for spinning dance motions along with radiating arc platforms for additional spin control, pad platforms for general use, a series of recession platforms that provide support for the receding, proximal end of the pad portion. The interstitial portion lacks significant protrusions and is elevated above the heel and pad portions. The heel portion includes an inclining heel peripheral platform circumscribing a substantially circular heel contact platform as well as an inclining central incline platform.

Therefore, there is a need for a sole that provides improved control in dance moves.

Furthermore, there is a need for a sole having improved wear patterns that do not fail over time.

Furthermore, there is a need for a sole having improved construction and comfort.

Furthermore, there is a need for a sole having improved construction able to withstand daily wear.

Furthermore, there is a need for a sole having reduced need to change shoes for dancing.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
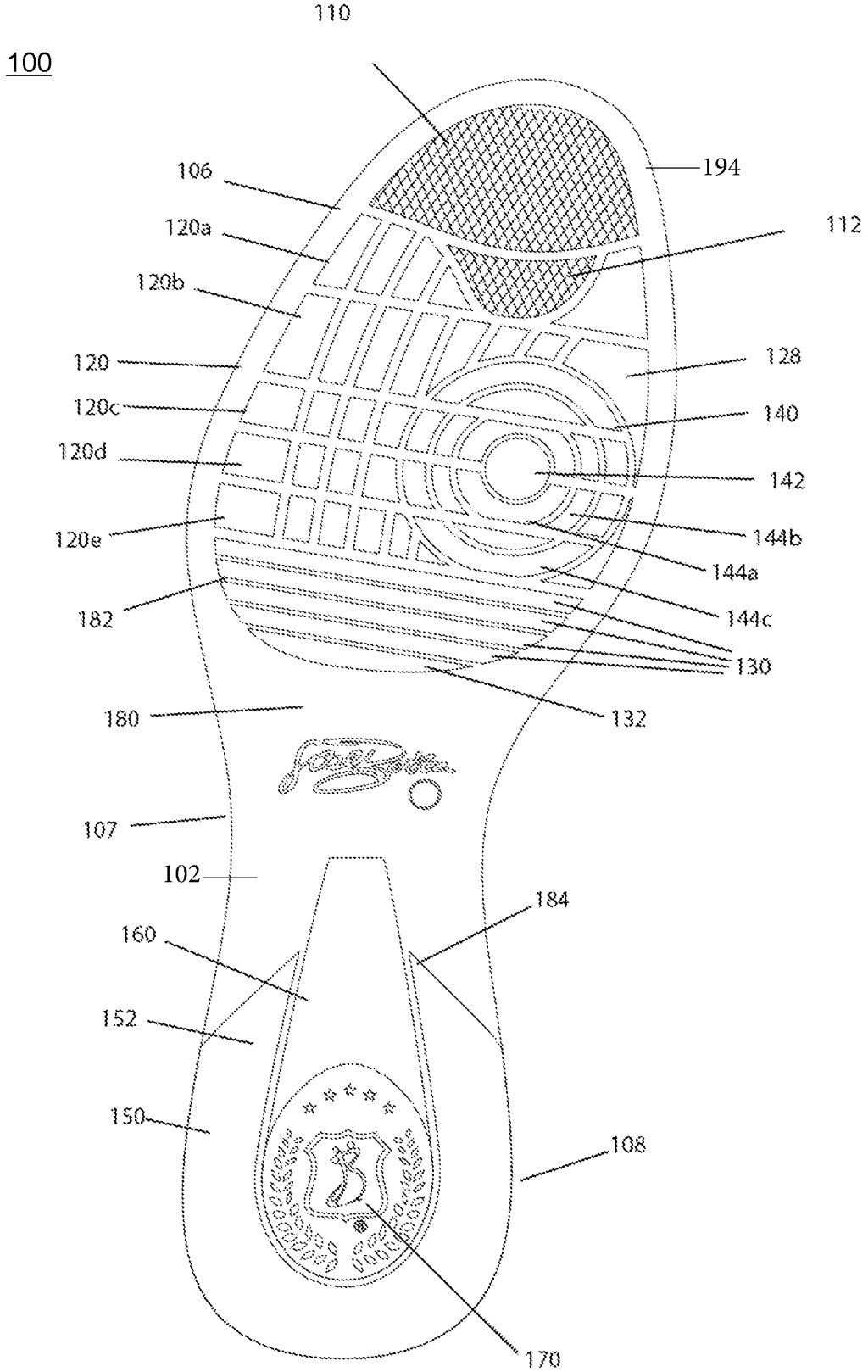
FIG. 1 is a plan view of the sole of the present invention.
Figure 2:
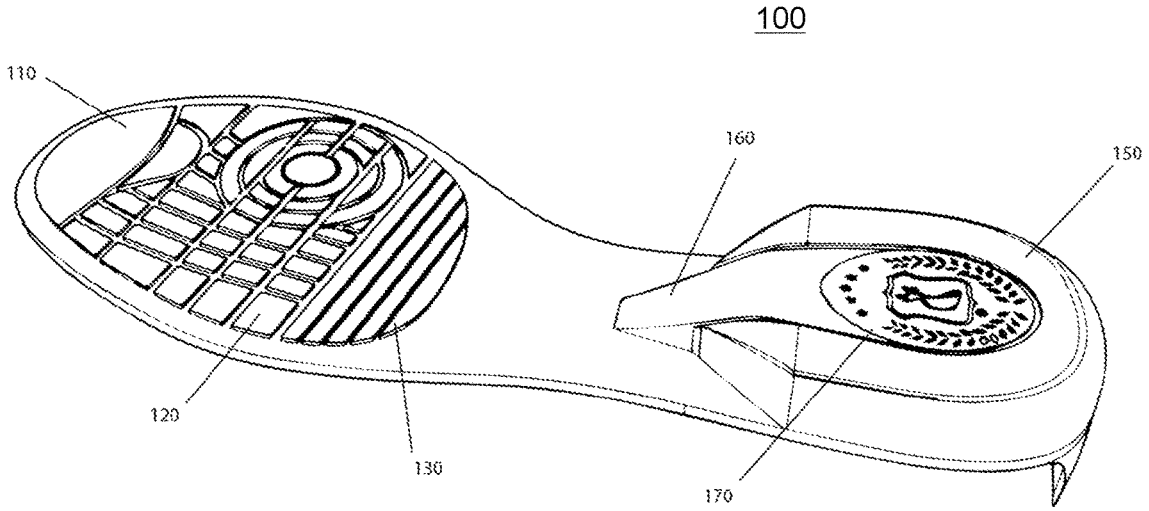
FIG. 2 is a perspective view of the sole of the present invention.
Figure 3:
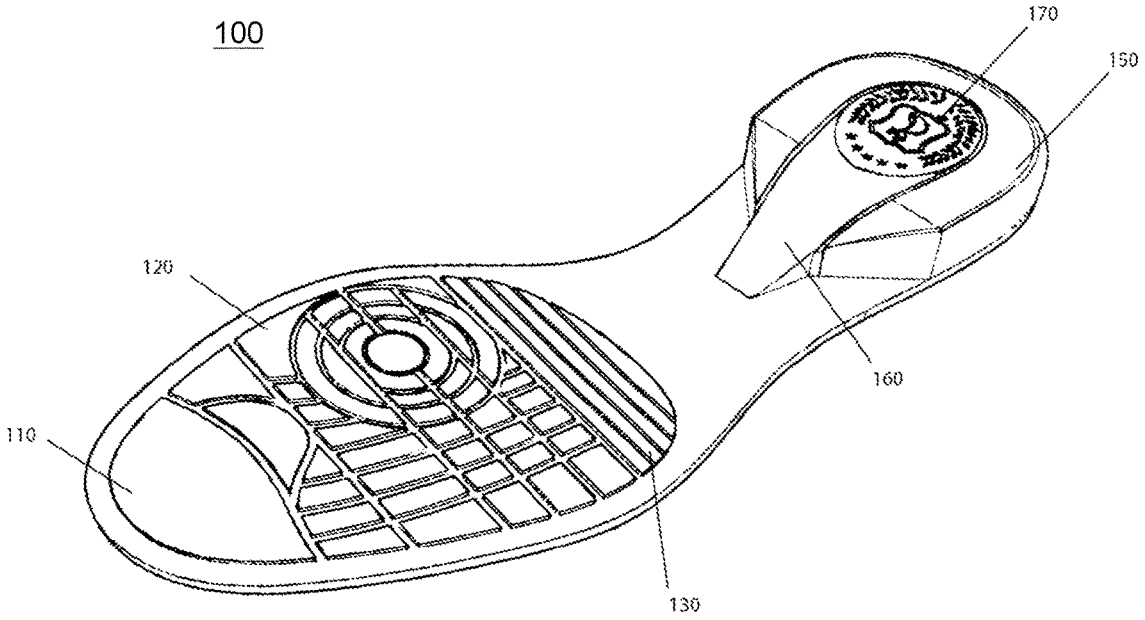
FIG. 3 is a perspective view of the sole of the present invention.
Figure 4:
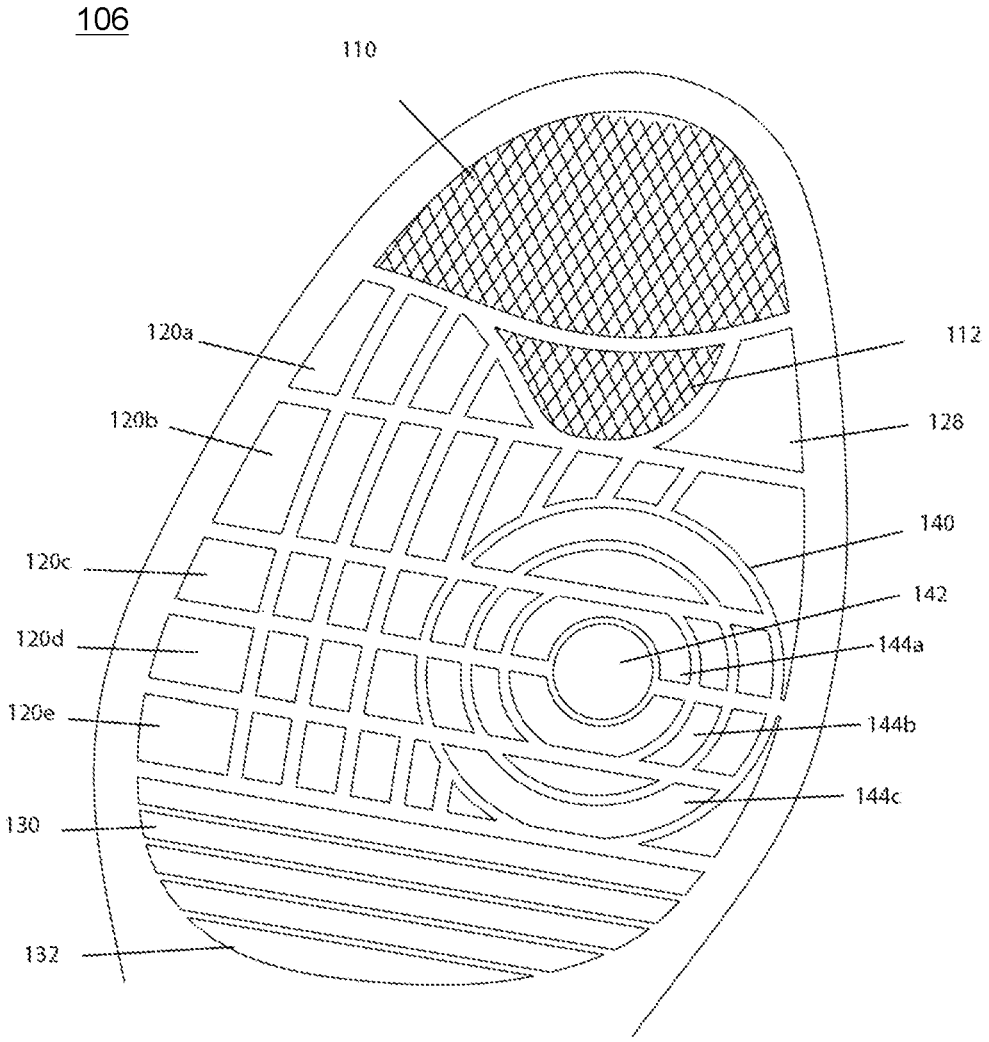
FIG. 4 is a portional, distal plan view of the sole of the present invention.

Referring first to FIG. 1, a basic embodiment of the shoe sole 100 is shown. The present invention fundamentally involves soles for dancing shoes that perform better than currently existing soles and can be worn daily. The present invention not only accomplishes the goals of traditional dance shoe suede sole bottoms, but also exceeds those goals. During the dance moves of spinning and twisting, the present invention provides relatively greater grip to stop and better foot placement control. This is largely due to the unique combination of flexibility, traction, and support on the proximal and distal regions of the sole. The sole includes an improved construction and comfort that minimizes wear while emphasizing dance performance.

The shoe sole 100 includes three portions, a foot pad portion 106, an interstitial portion 107, and a foot heel portion 108. These different portions of a shoe sole have specialized purposes both in general footwear and dance footwear.

Turning now to FIGS. 1-4 and 6, the footpad portion 106 of the present invention is specially designed to function as both general footwear and a dance shoe. As is the case in general footwear, the present invention includes pad platforms 120. Pad platforms 120 are those protrusions from the base 102 that form the primary basis of grip between footwear and the ground. Pad platforms are arranged about the foot pad 106 of the base 102. The preferred embodiment of the present invention includes multiple rows and columns of the pad platforms 120*a*, 120*b*, 120*c*, 120*d*, 120*e*. It is preferred that pad channels 182 run between the pad platforms 120 and run uninterrupted throughout the longitudinal and lateral portions of the shoe sole 100—except in limited circumstances. The pad platforms 120 are abutted by a contact platform 110, 112.

The major contact platform 110 is a substantially uninterrupted portion of the sole base 102 that protrudes at an approximately equal distance as the pad platforms 120. The major contact platform 110 includes a sinusoidal shape that conforms to the general curvature of the foot at the distal end of the sole. For purposes of the present disclosure, proximal includes those areas of the foot/sole closest to the ankle of the human body whereas distal includes those areas of the foot/sole farthest from the ankle. The sinusoidal shape is biased such that a uniform curve is not formed, but rather, the curve points in the direction of the interior of the human body, i.e., the area between the feet of a user. It is preferred that the contact platforms 110, 112 are unitary, and that the major contact platform 110 be uninterrupted by either lateral or longitudinal pad channels 182. Longitudinal and lateral pad channels provide flexibility and control, while the uninterrupted structure of platforms 110 and 112 produces gripping effect. In general, longitudinal channels allow for air flow for better motion of the foot, while lateral/traverse channels diminish resistance to bending and make for a very flexible sole.

Figure 6:
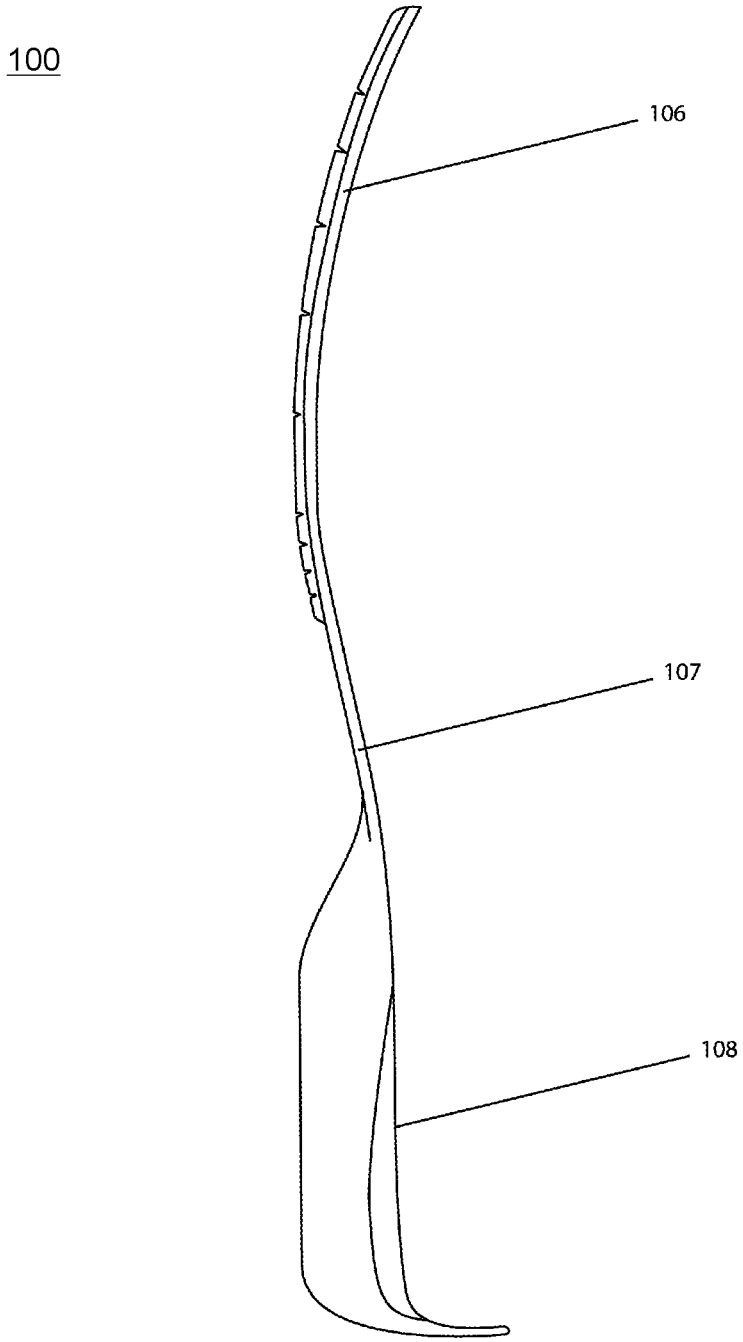
FIG. 6 is a side plan view of the sole of the present invention.

The major contact platform may protrude from one lateral portion of the sole to the other lateral portion of the sole and occupies that space between the toe mounds of the foot and the tips of the toes. With reference to FIG. 6, it is preferred that the portions occupied by the major platform 110 are elevated so they are not in contact with the ground in ordinary locomotion of a user's feet. The different platform portions of the distal portion of the sole 100 may be engulfed by periphery 194 that recedes beneath the platforms.

The elevation of the major contact platform permits the platform with a high coefficient of friction to be placed on a shoe and used only in situations requiring grippy surfaces. The grip of the contact platform should be significantly greater than the coefficient of friction of the pad platforms 120. The preferred gripping nature of the contact platform 110 is created by the use of an overlaid material or surface protrusions/perforations that create a high coefficient of friction. Preferred materials for use with the major contact platform include polyurethane and similar polymers. Polyurethane is light but highly abrasion-resistant and is excellent for hard-wearing shoe soles, with excellent long-term mechanical properties. Polyurethane soles are practical and keep water out, while permitting wide design potential. The sole may include preferred thickness of 3.0 mm as designed for daily wear and dance wear. The sole 100 may also feature a centralized supplement contact platform 112 distinct from the ultimately distal (i.e., farthest point) major contact platform and proximally located thereto. The supplemental contact platform 112 may be positioned between pad platforms, and preferably is so, and shares the lateral channeling, but not longitudinal channeling, characteristics therewith. The supplemental contact platform may be positioned on the portion of the sole that is in frequent common contact with the ground to enhance the grippiness of the sole, which is otherwise not provided by the pad platforms. The pad platforms are preferably perfectly smooth.

The pad platforms 120 additionally engulf another element of the sole 100, the pad spinner platform group 140. The pad spinner platform group 140 serves the purpose of permitting spin moves to be performed by the shoe bearing the sole 100. The group 140 includes two portions, a spinner center platform 142 and arcuate spinner secondary arc platforms 144 (144*a*, 144*b*, 144*c*) radiating therefrom. The spinner center platform 142 includes a substantially circular platform, in that it is either a circle or highly-rounded geometric figure, positioned proximate to the big toe mound to permit a dancer to spin without contacting a pad channel in ideal circumstances. However, because only experienced dancers can spin purely on the big toe mound, the radiating secondary arc platforms 144*a*, 144*b*, 144*c* provide additional support in the form of platforms that allow a largely unbroken pathway for the spinning of the sole about the center platform 142. Depending on the skill of a dancer, the dancer may invoke a one, two, or three layers or arc secondary platforms 144*a-c*. However, the purpose of channeling the protrusions of a sole are to permit shoe/sole flexibility. Although the inclusion of a limited area of unbroken protrusion, here the center spinner 142, may be appropriate, the arc secondary platforms 144 need some manner of separation. Channeling separate layers 144 laterally and longitudinally from the center spinner 142 and each other (144*a*, 144*b*, and 144*c*) so that the secondary arc platforms 144 appear similar to pad platforms 120, but with a portional circular orientation. Although it is preferred that they are not, if the secondary arc platforms 144 were joined, it is preferred that they would form a complete circle because there is symmetry throughout the circular portions. The texture of the spinner platform group is smooth with a relatively low coefficient of friction. It is preferred that the spinner group 140 be entirely engulfed by pad protrusions 120. Special pad protrusions 128 having dimensions and orientations that complement the circular spinner group platforms 140 are used to directly surround the spinner group 140 that allow substantial contact of the foot's edge to occur on the sole other than the spinner group 140.

Proximal to the pad platforms 120 and spinner platform group 140 are the recession platforms 130. The recession platforms 130 are preferably relatively smooth, non-grippy protrusions that run entirely laterally across the sole 100 to permit support for that portion of the sole that elevates upward in the proximate direction. The pad platforms may be completed with a recession platform supplement 132 that forms a sinusoidal shape biased to the distal, exterior inner portion of the feet.

Subsequent to the foot pad 106 is the interstitial pad 107. The interstitial pad 107 includes a transition plane that is free from protrusions because the sole of the present invention lacks a need for ground support in this area. In a preferred embodiment, there is a transition plane 180 that is unfettered with protrusions until the heel portion 108.

Figure 5:
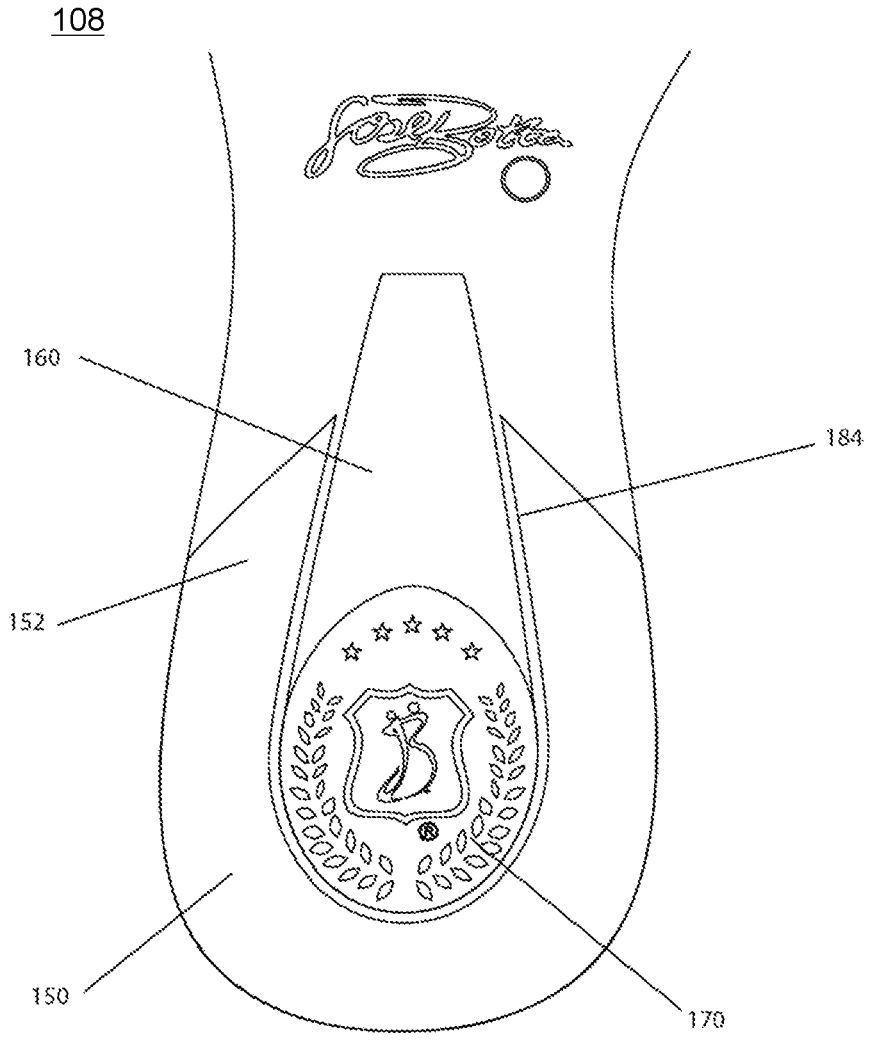
FIG. 5 is a portional, proximal plan view of the sole of the present invention.

Turning now to FIGS. 1, 5-6, the heel portion 108 of the sole 100 of the present invention includes a heel central incline platform 160 that gradually inclines to a heel contact platform 170. The heel contact platform 170 includes a substantially circular, preferably an ellipse as shown, platform that supports the central portion of the heel of a user's foot. The heel central incline platform 160 is positioned centrally within the sole so that it is relatively distant from the lateral edges of the sole. The central incline platform 160 and the heel contact platform 170 are engulfed by the heel peripheral platform 150 that is positioned at the lateral edges of the sole as well as the ultimate proximal portion of the sole. The heel peripheral platform 150 forms a horseshoe-like shape that allows primary contact with the ground. The heel contact platform 170 includes a preferably grippy texture that contrasts with the smooth texture of the incline central platform 160 and the heel peripheral platform 150 which also preferably inclines commensurate with the central platform. It is further preferred that the peripheral platform 150 expand from the center as it recedes proximally into a pair of platform wings 152. The heel portion of the shoe is preferably twenty mm, which is found to permit an excellent combination of good dance and wear performance.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein. However, because the preferred form of the present invention is depicted in the drawings of the present disclosure, a scale is provided that permits accurate relationships to be drawn between sole components.

What is claimed is:

1. A shoe sole comprising:

a base having a proximal end corresponding to areas of the shoe sole closest to an ankle of the user wearing a shoe bearing the shoe sole and a distal end farthest from the ankle;

a foot pad surrounded by a periphery of the base and disposed closer to the distal end than to the proximal end of the base, the foot pad including:

a plurality of pad platforms protruding from the base and forming the primary basis of grip between the shoe sole and a ground on which the shoe bearing the shoe sole is used, the pad platforms being arranged in multiple rows and columns with lateral and longitudinal pad channels running therebetween, the lateral and longitudinal pad channels providing flexibility and control by the longitudinal pad channels allowing air flow for better motion of the user's foot and by the lateral pad channels providing flexibility to the shoe sole;

a major contact platform protruding from the base at an approximately equal distance as the pad platforms so as to be uninterrupted by the lateral and longitudinal pad channels, the major contact platform having a coefficient of friction higher than that of the pad platforms for producing a gripping effect for controlled stops performed by the shoe bearing the shoe sole;

a supplemental contact platform distinct from and disposed proximate to the major contact platform at a portion of the base configured for frequent contact with the ground to enhance a gripping effect of the shoe sole, the supplemental contact platform being entirely disposed between and surrounded by an adjacent portion of the major contact platform and adjacent ones of the pad platforms so as to be spaced apart therefrom by selected ones of the pad channels;

a spinner platform group surrounded by the pad platforms and having a lower coefficient of friction relative to the major contact platform to permit spin moves to be performed by the shoe bearing the shoe sole, the spinner platform group including a circular spinner center platform that permits spinning movements and arcuate spinner secondary arc platforms radiating from the spinner center platform to provide additional support allowing spinning of the shoe about the spinner center platform, the lateral pad channels running through the spinner platform group, except for the spinner center platform, to form the arcuate spinner secondary arc platforms; and a plurality of recession platforms configured to provide support for the pad platforms, the recession platforms comprising a plurality of smooth protrusions disposed proximate to and directly below the pad platforms and the spinner platform group, the protrusions being separated by lateral channels running laterally across the base;

a heel including:

a first platform configured to support a central portion of the user's foot, the first platform having a grippy texture with a high coefficient of friction;

a second platform gradually inclining toward the first platform and disposed in direct contact therewith so as to partially surround the first platform, the second platform being positioned centrally on the base and at a distance from lateral edges of the base, and the second platform having a lower coefficient of friction than that of the first platform; and a third platform configured for primary contact with the ground, the third platform surrounding the first platform and the second platform and having a lower coefficient of friction than that of the first platform; and an interstitial pad disposed between the foot pad and the heel, the interstitial pad including a transition plane elevated above the heel with respect to a ground surface on which the shoe bearing the shoe sole is configured to be used.

2. The shoe sole of claim 1, wherein the major contact platform is elevated so that it does not contact the ground during ordinary movement of the user's foot wearing the shoe bearing the shoe sole, the major contact platform having a sinusoidal shape that conforms to the general curvature of the user's foot at the distal end of the base.

3. The shoe sole of claim 1, wherein the second platform gradually inclines from a position proximate the interstitial pad toward the first platform.

4. The shoe sole of claim 1, wherein the major contact platform does not laterally intersect the plurality of pad platforms.

5. The shoe sole of claim 1, wherein the supplemental contact platform is laterally surrounded by the adjacent ones of the pad platforms.

6. The shoe sole of claim 1, wherein the major contact platform includes a sinusoidal curve facing toward the distal end of the shoe sole, and the supplemental contact platform includes a sinusoidal curve facing toward the proximal end of the shoe sole.

7. The shoe sole of claim 1, wherein the recession platforms are disposed parallel to one another.

8. The shoe sole of claim 1, wherein the foot pad further includes pad protrusions extending directly from the periphery of the base and directly surrounding the spinner platform group.

9. The shoe sole of claim 1, wherein each of the first, second and third platforms is symmetrical about a vertical line extending through a center of the heel; and wherein the third platform has a pair of platform wings, the second platform having a portion extending outwardly from the pair of platform wings in a direction toward the distal end of the base.

10. A shoe sole comprising:

a base having a proximal end corresponding to areas of the shoe sole closest to an ankle of the user wearing a shoe bearing the shoe sole and a distal end farthest from the ankle;

a foot pad surrounded by a periphery of the base and disposed closer to the distal end than to the proximal end of the base, the foot pad including:

a major contact platform proximate the distal end of the base and configured for controlled stops performed by the shoe bearing the shoe sole, the major contact platform having a substantially rounded distal end positioned corresponding to all toe tips of a foot of the user of the shoe bearing the shoe sole;

a spinner platform group having a circular spinner center platform circumscribed by multiple, distinct arc platforms arranged in at least two layers, the spinner center platform having a low coefficient of friction permitting spinning moves to be performed by the shoe bearing the sole, the arc platforms being configured for additional spin control to the spinning moves by the spinner center platform, and the spinner platform and the arc platforms having a grip substantially less than a grip of the major contact platform;

a plurality of distinct pad platforms arranged in multiple rows and columns and surrounding the spinner platform and the arc platforms;

a plurality of longitudinal and lateral channels forming the plurality of distinct pad platforms, the lateral channels running through the spinner platform group, except for the circular spinner platform, to form the multiple distinct arc platforms;

a plurality of recession platforms laterally spanning the base and disposed proximate to and directly below the plurality of distinct pad platforms and the multiple distinct arc platforms, the plurality of recession platforms being separated by lateral channels running laterally across the base;

a heel disposed at the proximal end of the base, the heel including:

a first platform having a grippy texture with a high coefficient of friction;

a second platform disposed in direct contact with the first platform; and a third platform positioned along lateral edges of the base so as to surround the first and second platforms, the coefficient of friction of the first platform being higher than a coefficient of friction of each of the second platform and the third platform; and an interstitial pad disposed between the foot pad and the heel, the interstitial pad being elevated above the heel with respect to a ground surface on which the shoe bearing the shoe sole is configured to be used.

11. The shoe sole of claim 10, wherein the second platform is distinct from the third platform, the second platform having a portion that extends entirely distally from the third platform.

12. The shoe sole of claim 10, wherein the major contact platform does not laterally intersect the plurality of distinct pad platforms.

13. The shoe sole of claim 10, wherein the foot pad further includes a minor contact platform distinct from and positioned proximally to the major contact platform, the minor contact platform being disposed entirely between and surrounded by an adjacent portion of the major contact platform and adjacent ones of the distinct pad platforms so as to be spaced apart therefrom by selected ones of the channels.

14. The shoe sole of claim 13, wherein the major contact platform includes a sinusoidal curve facing toward the distal end of the shoe sole, and the minor contact platform includes a sinusoidal curve facing toward the proximal end of the shoe sole.

15. The shoe sole of claim 14, wherein the major contact platform and the minor contact platform include asymmetric curves configured to point in a direction of an area between the user's foot.

16. The shoe sole of claim 10, wherein:

the recession platforms comprise smooth protrusions separated by lateral channels running laterally across the base and are configured to provide support for the plurality of distinct pad platforms, the recession platforms including a recession platform supplement that includes a sinusoidal curve facing toward the proximal end of the base.

17. The shoe sole of claim 10, wherein the major contact platform is elevated so that it does not contact the ground during ordinary movement of a user's foot wearing the shoe bearing the shoe sole.

18. The shoe sole of claim 10, wherein the recession platforms are disposed parallel to one another.

19. The shoe sole of claim 10, wherein the foot pad further includes pad protrusions extending directly from the periphery of the base and directly surrounding the spinner platform group.

20. The shoe sole of claim 10, wherein each of the first, second and third platforms is symmetrical about a vertical line extending through a center of the heel; and wherein the third platform has a pair of platform wings, the second platform having a portion extending outwardly from the pair of platform wings in a direction toward the distal end of the base.

* * * * *